United States Patent [19]

Hofland

[11] Patent Number: 4,750,279

[45] Date of Patent: Jun. 14, 1988

[54] MOBILE APPARATUS FOR CARRYING OUT WORK BOTH ABOVE AND BELOW WATER

[76] Inventor: Jacobus M. J. Hofland, Noorderweg 11b, 1948 PJ Beverwijk, Netherlands

[21] Appl. No.: 898,245

[22] Filed: Aug. 19, 1986

[30] Foreign Application Priority Data

Sep. 10, 1985 [NL] Netherlands ..... 8502470

[51] Int. Cl.[4] ..... E02F 3/88

[52] U.S. Cl. ..... 37/58; 37/72

[58] Field of Search ..... 37/56, 72, 73, 54

[56] References Cited

U.S. PATENT DOCUMENTS

| | | | |
|---|---|---|---|
| 3,333,562 | 8/1967 | Deal, Jr. et al. | 37/54 X |
| 3,500,648 | 3/1970 | Daniell | 37/56 X |
| 3,568,454 | 3/1971 | Itami | 37/56 X |
| 3,683,521 | 8/1972 | Sloan et al. | 37/56 |
| 3,755,932 | 9/1973 | Cargile, Jr. | 37/67 |
| 3,905,137 | 9/1975 | Gee | 37/56 |
| 3,983,707 | 10/1976 | Lezgintsev et al. | 37/56 X |

FOREIGN PATENT DOCUMENTS

| | | | |
|---|---|---|---|
| 0034857 | 9/1981 | European Pat. Off. . | |
| 997304 | 1/1952 | France . | |
| 7205310 | 4/1972 | Netherlands . | |
| 1218904 | 1/1971 | United Kingdom | 37/56 |

*Primary Examiner*—Clifford D. Crowder

*Attorney, Agent, or Firm*—Parmelee, Bollinger & Bramblett

[57] ABSTRACT

Mobile dredging apparatus movable on caterpillar tracks (2) or the like and provided with an energy unit (8,10), energy consuming motors (11) for moving and dredging and extendable line connections (9) between unit (8,10) and motors (11). The unit is removable and can be placed at a higher level (15) of the frame or on a vessel (16) so that the dredging area can reach from the beach through the coastal area up to the water depths corresponding to the length of the line connection (9).

2 Claims, 1 Drawing Sheet

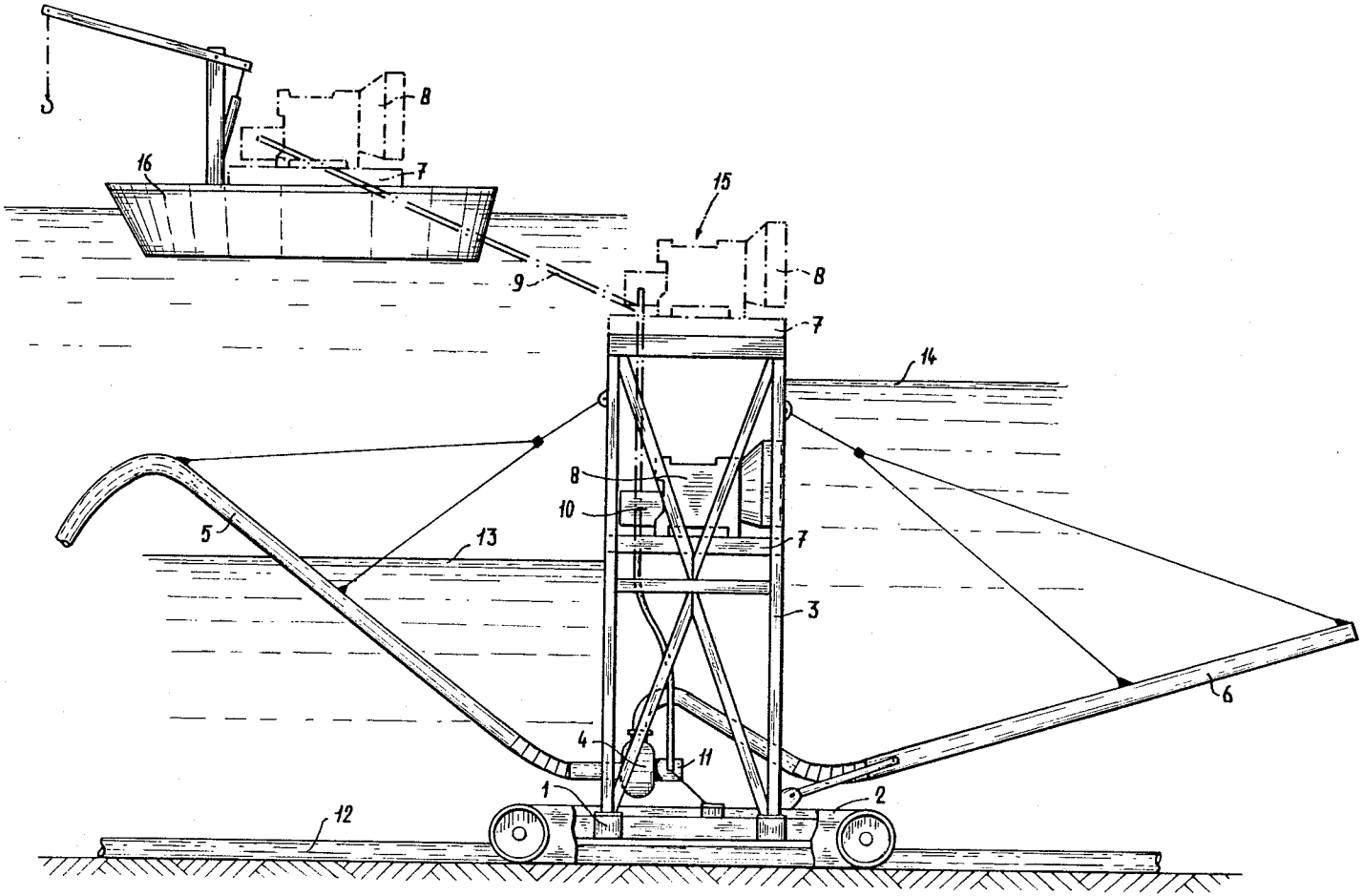
1
2
3
4
5
6
7
8
9
10
11
12
13
14
15
16

MOBILE APPARATUS FOR CARRYING OUT WORK BOTH ABOVE AND BELOW WATER

The invention relates to a mobile apparatus for carrying out work both above and below water, such as earth-moving work, comprising a frame with means for shifting the frame, such as driven caterpillar tracks, means for carrying out the work, such as a dredge pump with suction and delivery line, and with an energy source in the form of a combustion engine and a dynamo or pump driven by it with connections to electric motors or hydraulic motors respectively for driving the shifting means and for driving the equipment such as the dredge pump.

Such an apparatus is known from Dutch Patent Application No. 8001152, laid open for inspection, corresponding to European Patent No. 034857. This known mobile apparatus is capable of carrying out work such as dredging activities from dry land, for example on a sea coast, towards the water and therein, and is capable of working up to a depth of several metres under water, due to the fact that the control point is movable in the vertical direction, so that the driver remains above water, and due to the fact that the sealed energy source for the supply of combustion air and the discharge of exhaust gases has pipe connections projecting above water. This apparatus cannot be used at greater water depths, but it can be used where ordinary dredging equipment or suction dredger equipment can no longer operate, for the latter is formed by a floating body which needs a certain depth of water. The known apparatus is therefore excellently suited for working in the breakers area and has already proved its usefulness for quickly getting afloat ships which have run aground.

The object of the invention is then to produce an improved mobile apparatus which can operate much further away from the coast, while retaining the possibilities for working in shallow water, the breakers area, or on the coast. The object of the invention is also to produce an apparatus which is simple.

This object is achieved according to the invention in that the energy source, consisting of engine and dynamo or pump, is removable from the frame, can be placed on another body, in particular a floating body, and by means of unreeling or extending cable or hoses is coupled to the motors in the frame.

The use of a removable energy source which is driven by a combustion engine and is thus independent of remotely situated facilities gives the advantage that the energy source need not be sealed off in watertight fashion. For, by making the energy source removable, one can lift it or hold it above water when the apparatus goes into deeper water during the carrying out of work. The frame can for that purpose have an upward-directed part in which the energy source can be placed at different levels, so that with increasing water depth the energy source is moved upwards either by the upward movement of a platform or by placing of the energy source higher up. If the frame is not high enough, the energy source can also be placed on a floating body, such as a ship, and from there the motors in the frame can be provided with energy by means of the cables or hoses.

Unreeling or extending cable or hoses for transmission of the energy can be many tens or hundreds of meters long, so that after placing of the energy source on a vessel the apparatus can drop down further in the sea. The working range is thereby extended from a known range of several hundred meters to a range of many tens of kilometers.

It is pointed out that it is known per se, for example from Dutch Patent Application No. 7205310, laid open for inspection, to provide a mobile dredging apparatus with energy from an energy source which is set up on the coast. The connection takes place by means of a cable running from the energy source to the mobile apparatus and supported by floats.

Here the working range, calculated from the coast, is limited by the length of the cable. For, if the apparatus had to work many kilometers from the coast, the cable would have to be of a corresponding length, while cables or hoses which go downwards from a surface vessel are of a length which is only a fraction of the length needed for the known apparatus.

It is further pointed out that it is also known to provide apparatuses which can move over the seabed with energy from a vessel in which the connection is made again by cables or hoses. Here the mobile apparatus is lowered or raised and controlled from the vessel.

Such apparatuses can work in deep water and approach a coast up to a certain depth of water, but they then have to pass the work over to another apparatus.

What the invention now achieves is precisely that one can continue to work without restriction from dry land to very far out to sea, and vice versa, using one and the same apparatus.

The invention will now be explained in greater detail with reference to the drawing.

It shows schematically in side view an apparatus according to the invention.

The apparatus comprises a frame 1 with caterpillar tracks 2 and placed thereon an upward-directed frame part 3. Placed in the frame is a dredge pump 4 with suction line 5 and delivery line 6.

The frame has a platform 7 on which is disposed the energy source, consisting of a combustion engine with pump, in its entirety indicated by 8.

The outlet of the pump, such as a high-pressure oil pump, is connected to a hose 9 by means of a hose drum 10 which is known per se. In the drawing this hose 9 is connected to a hydraulic motor 11 of the dredge pump 4.

The apparatus is shown mobile over a pipeline 12 which is, for example, to be entrenched by means of this apparatus.

In the position of the energy source 8 indicated by solid lines it is above the water level 13. When the apparatus drops further down in the water, resulting for example in a water level indicated by 14, the energy unit is moved upwards beforehand to the position indicated by dashed lines at 15, this being done by moving the platform 7 upwards or by lifting the energy source 8 from the platform 7 and placing it on a platform higher up.

If the frame part 3 is not high enough, the energy source 8 can also be placed on a ship 16.

The vertical distance between the energy source 8 on the ship 16 and the motors to be driven, such as the motor 11, is then determined only byt he length of the hose 9, which thus determines the depth at which the apparatus can still be used.

Although only one hose 9 or cable is shown, it will be clear that several hoses are possible here, for example a second hose for the drive motors of the caterpillar tracks and further hoses for control. The control position can be located at the energy source and thus goes along with it to a position which is always above water. Energy source 8 and control are then always in the most suitable place.

I claim:

1. A mobile apparatus for carrying out work on a wet surface below a body of water as well as on the dry area above water of the shore of said body of water, said mobile apparatus comprising a frame with rotatably means for supporting the apparatus and moving the apparatus on the dry area of the shore as well as over the bottom of the adjacent body of water from the shore into the water and visa versa, said frame carrying a dredging apparatus comprising a suction-pressure pump having suction and pressure tubes connected to said pump and a motor means for driving said dredging apparatus, said frame having an upwardly extending portion provided with a plurality of supports at different levels, a displaceable power unit, each support being adapted to carry said displaceable power unit for said dredging apparatus, and an extendable power line which is adapted to be connected between the said power unit and said motor means regardless of level on said frame that said power unit is positioned.

2. The apparatus as claimed in claim 1 having an independent floating device with support means on said floating device for supporting said power unit, said extendable power line being adapted to connect the power unit on said floating device with said motor means on said frame.

* * * * *